US006843757B2

(12) United States Patent
Pan et al.

(10) Patent No.: US 6,843,757 B2
(45) Date of Patent: Jan. 18, 2005

(54) ADJUSTING DEVICE FOR A TREAD BOARD OF A TREADMILL

(75) Inventors: John C. Pan, Taichung (TW); Shih-Huang Chu, Taichung (TW)

(73) Assignee: Forhouse Corporation, Taichung Hsien (TW)

( * ) Notice: Subject to any disclaimer, the term of this patent is extended or adjusted under 35 U.S.C. 154(b) by 176 days.

(21) Appl. No.: 10/174,885

(22) Filed: Jun. 19, 2002

(65) Prior Publication Data

US 2003/0236153 A1 Dec. 25, 2003

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS 5,518,471 A * 5/1996 Hettinger et al. ..... 482/54
5,676,624 A * 10/1997 Watterson et al. ..... 482/54
5,868,648 A * 2/1999 Coody et al. ..... 482/54
6,585,624 B1 * 7/2003 Chen ..... 482/54

* cited by examiner

*Primary Examiner*—Glenn E. Richman
(74) *Attorney, Agent, or Firm*—Head, Johnson & Kachigian

(57) ABSTRACT

An adjusting device for a tread board of a treadmill has an actuating device, a transmission device and a connecting member. The actuating device is pivotally connected to a bottom of the tread board. The transmission device is connected to the actuating device. The connecting member is connected to the transmission device with a first end and has a second end pivotally attached to the tread board. The connecting member has a middle point pivotally attached to a stand. Accordingly, the actuating device and the transmission device can actuate the connecting member to rotate relative to the stand, and the angle of the tread board relative to the ground is adjusted. Because the transmission device can pivotally rotate relative to the tread board, a large force will not be applied to the transmission device. Consequently, the load bearing of the transmission device is reduced.

9 Claims, 7 Drawing Sheets

ADJUSTING DEVICE FOR A TREAD BOARD OF A TREADMILL

BACKGROUND OF THE INVENTION

1. Field of the Invention

The present invention relates to an adjusting device, and more particularly to an adjusting device for a tread board of a treadmill.

2. Description of Related Art

To adjust the angle of the tread board of a treadmill relative to the ground, an adjusting device is mounted on the treadmill. With reference to FIG. 7, a conventional adjusting-device for a tread board (40) of a treadmill comprises a stand (50), two connecting pieces (52), a thread rod (54), a sleeve (56) and a motor (58). One end of each connecting piece (52) is pivotally attached to one side of the tread board (40), and a connecting bar (not shown) is mounted between the other ends of the connecting pieces (52). Each connecting piece (52) has a middle point pivotally attached to the stand (50). One end of the thread rod (54) is pivotally attached to the connecting bar, and the other end of the thread rod (54) engages with an inner thread defined in the sleeve (56). The sleeve (56) is rotatably secured on the stand (50) and is connected to the motor (58). When the motor (58) is switched on, the sleeve (56) will rotate relative to the stand (50) and the thread rod (54) will move forward or backward relative to the sleeve (56). Consequently, the connecting pieces (52) will be pushed or pulled to pivotally rotate relative to the stand (50), and then the tread board (40) is lifted up or lowered.

However, because the sleeve (56) is rotatably secured on the stand (56), the sleeve (56) and the thread rod (54) cannot pivotally rotate relative to the stand (50). The thread (54) can only move in a straight travel, and the motor (58) is kept stationary during the operation of the conventional adjusting device. A large force will be applied to the thread rod (54) and the sleeve (56) to urge the thread rod (54) and the sleeve (56) to pivotally rotate relative to the stand (50) during the rotation of the connecting pieces (52). Therefore, the load bearing on the thread rod (54) and the sleeve (56) of the conventional adjusting device is very large such that the thread portions of the thread rod (54) and the sleeve (56) are easily damaged after a certain amount of use. In addition, because the motor (58) is mounted on the stand (50), a large space below on the tread board (40) is needed to arrange the adjusting device. Consequently, the lowest position of the tread board (40) is still at a certain height, and this causes the treadmill to be unstable in use.

To overcome the shortcomings, the present invention tends to provide an adjusting device to mitigate or obviate the aforementioned problems.

SUMMARY OF THE INVENTION

The main objective of the invention is to provide an adjusting device for a tread board of a treadmill and that has a light load bearing on a transmission device. The adjusting device has an actuating device, a transmission device and a connecting member. The actuating device is pivotally connected to a bottom of the tread board. The transmission device is connected to the actuating device. The connecting member is connected to the transmission device with a first end and has a second end pivotally attached to the tread board. The connecting member has a middle point pivotally attached to a stand of the treadmill. Accordingly, the actuating device and the transmission device can actuate the connecting member to rotate relative to the stand so as to adjust the angle of the tread board relative to the ground. Because the transmission device is pivotally connected to the tread board, the load bearing on the transmission device is low.

Other objects, advantages and novel features of the invention will become more apparent from the following detailed description when taken in conjunction with the accompanying drawings.

DETAILED DESCRIPTION OF PREFERRED EMBODIMENT

Figure 1:
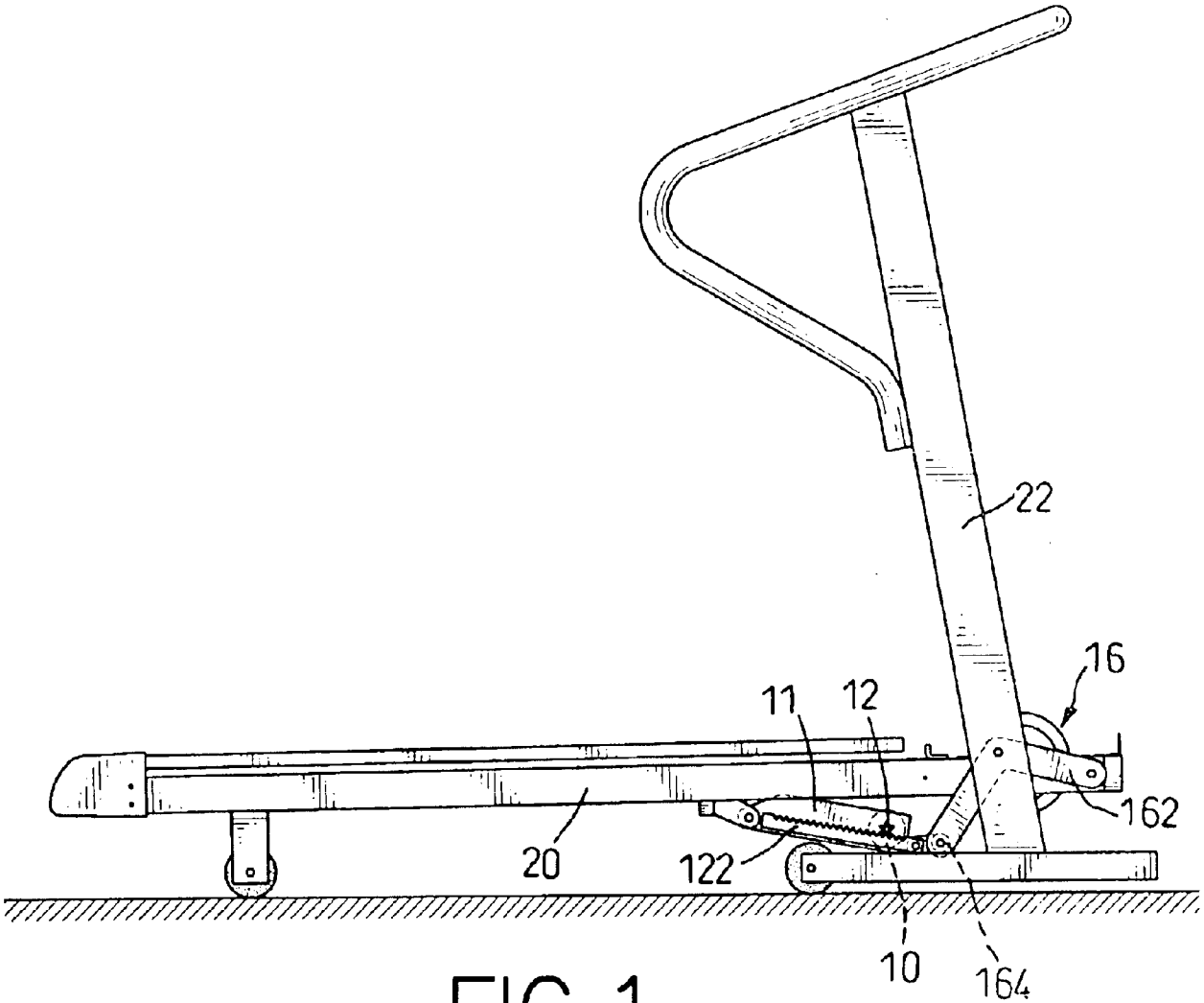
FIG. 1 is a side plan view of a treadmill with a first embodiment of an adjusting device in accordance with the present invention.
Figure 2:
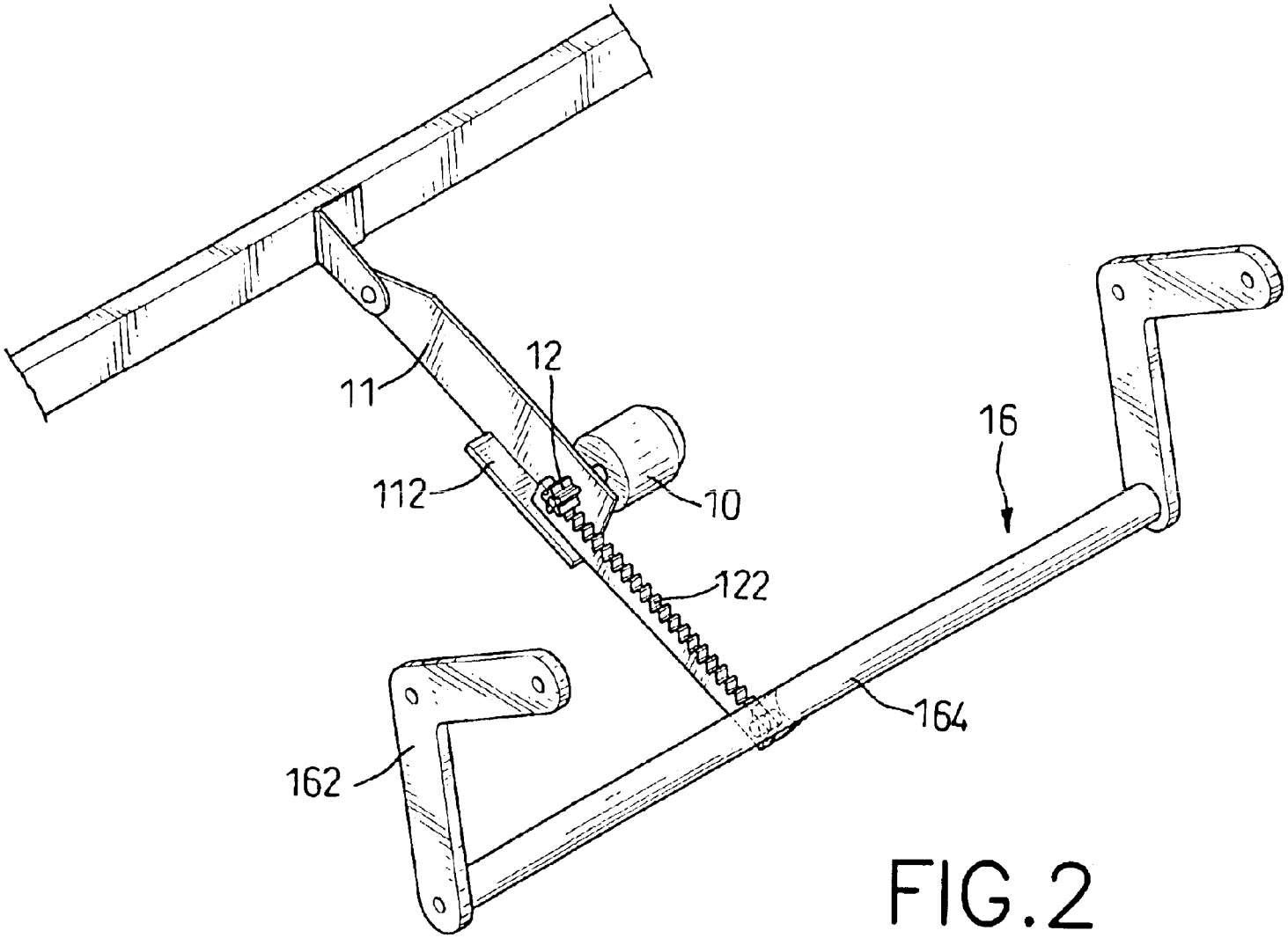
FIG. 2 is a perspective view of the adjusting device in FIG. 1.

With reference to FIGS. 1 and 2, an adjusting device for a treadmill in accordance with the present invention comprises an actuating device (10), a transmission device and a connecting member (16). The actuating device (10) is pivotally connected to the bottom of the tread board (20) of the treadmill. In practice, the actuating device (10) is a motor that is secured to a bracket (11). The bracket (11) is pivotally attached to the bottom of the tread board (20), such that the motor is pivotally connected to the tread board (20) through the bracket (11).

The transmission device is connected to the actuating device (10), such that the transmission device can pivotally rotate relative to the tread board (20). In a first embodiment, the transmission device comprises a pinion (12) and a rack (122). The pinion (12) is connected to the shaft of the motor. The rack (122) is moveably mounted on the bracket (11) and engages with the pinion (12). A tab (112) laterally extends outward from the bottom of the bracket (11) to support the rack (122). Accordingly, when the actuating device (10) is switched on, the rack (122) will move relative to the bracket (11) by means of the transmission of the pinion (12).

The connecting member (16) is connected between the transmission device and the tread board (20) and has a middle point pivotally attached to a stand (22) of the treadmill. The connecting member (16) comprises two pivoting arms (162) and a connecting rod (164). The pivoting arms (162) are respectively located on two sides of the tread board (20). Each pivoting arm (162) has an end pivotally attached to one side of the tread board (20) and a middle point pivotally attached to the stand (22). The connecting rod (164) is connected between the other ends of the pivoting arms (162) and has a middle point pivotally connected to the rack (122). In practice, the ends of the pivoting arms (162) opposite to the tread board (20) are directly attached to one end of the rack (122), such that the connecting rod (164) is not needed.

Figure 3:
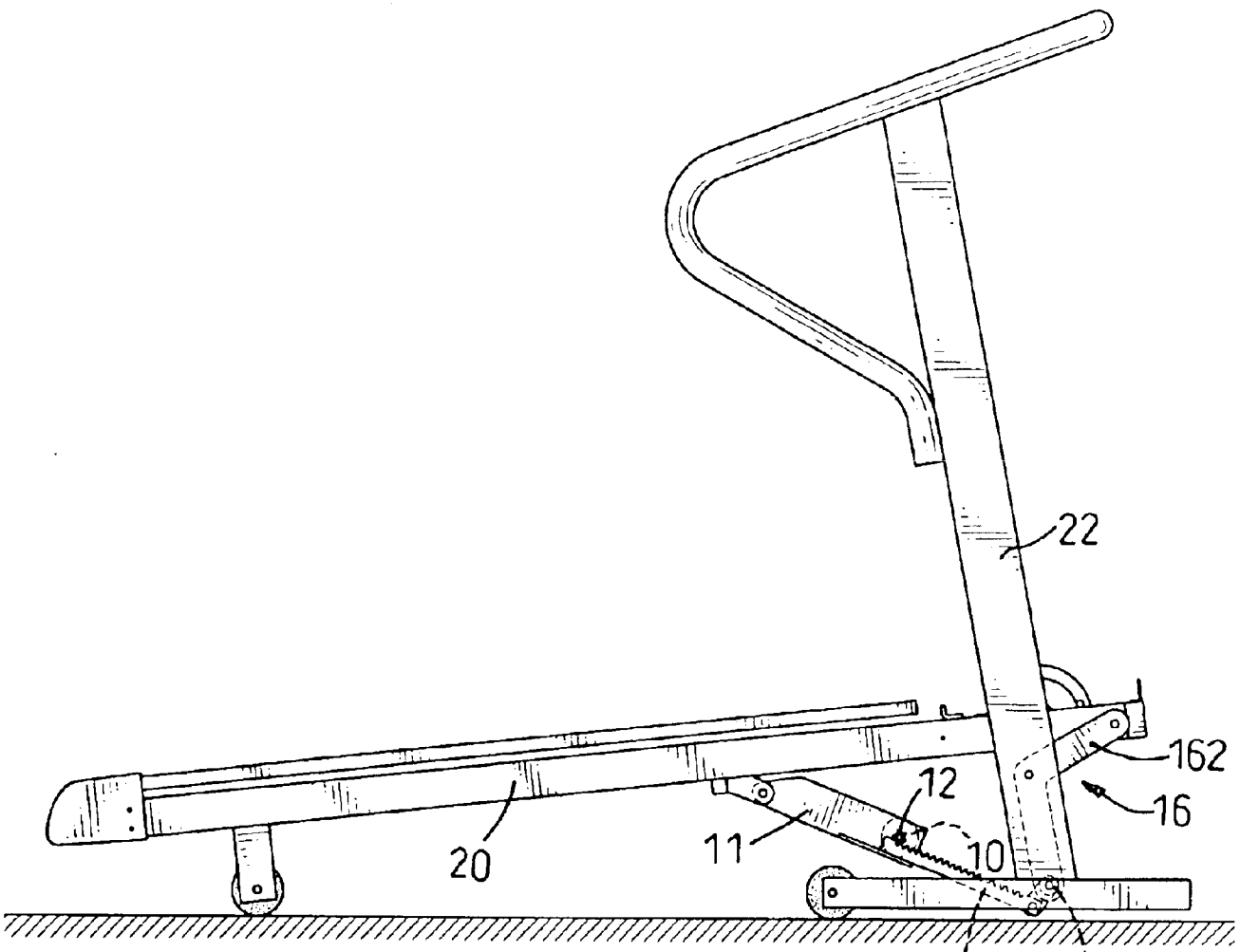
FIG. 3 is an operational side plan view of the treadmill with the adjusting device in FIG. 1 showing that the angle of the tread board is adjusted.

With reference to FIGS. 2 and 3, when the actuating device (10) is switched on, the rack (122) will move relative to the bracket (11) by means of the transmission of the pinion (12). The pivoting arms (162) will be pushed or pulled to rotate relative to the stand (22), such that the ends of the pivoting arms (162) connected to the tread board (20) will move upward or downward according to the movement direction of the rack (122). Consequently, the angle of the tread board (20) relative to the ground is adjusted.

In such an adjusting device, because the connecting member (16) is pivotally attached to the stand (22) at a middle point of the connecting member (16), the weight of the tread board (20) and the user can be efficiently supported by the stand (20). Furthermore, because the transmission device is connected to the actuating device (10) that is pivotally connected to the tread board (20), the actuating device (10) and the transmission device can pivotally rotate relative to the tread board (20) during the operation of the adjusting device. As the figures showing, the rack (122), the bracket (11) and the motor (12) mounted on the bracket (11) will pivotally rotate relative to the tread board (20), when the connecting member (16) rotates relative to the stand (22). A large force will not be applied to the transmission device, such that the load bearing of the transmission device is reduced. Thus, the transmission device will not be easily damaged even after a long time of use so that the useful life of the adjusting device is prolonged.

Figure 7:
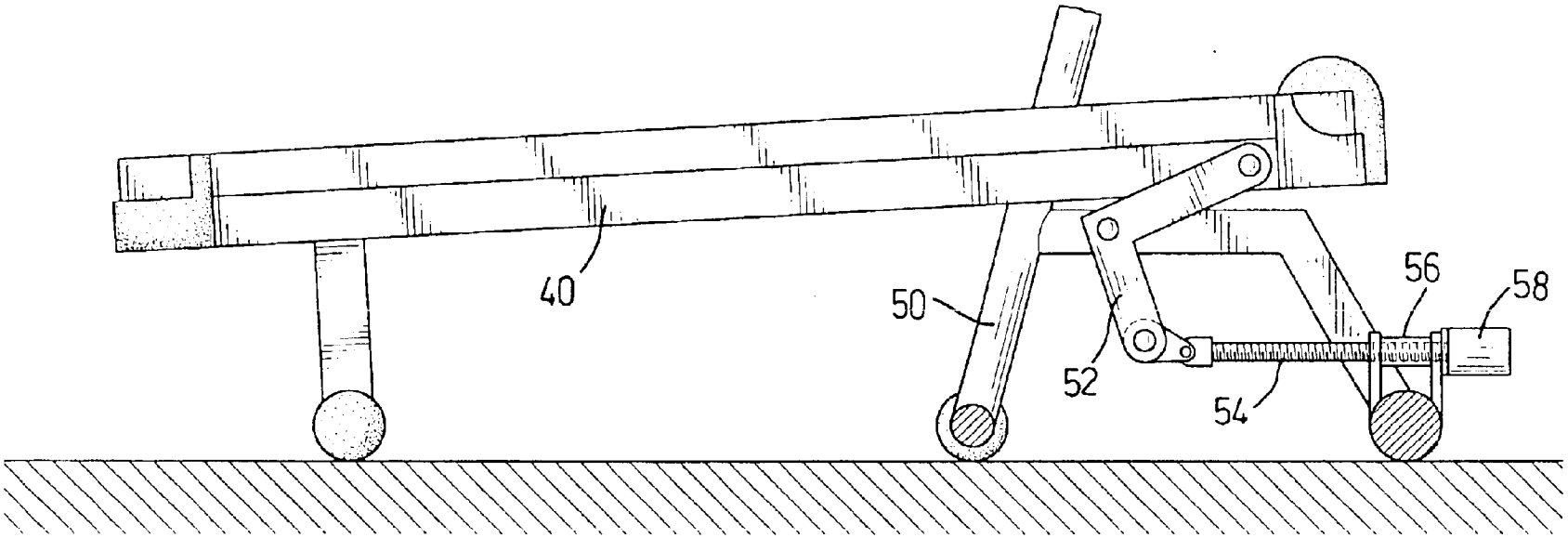
FIG. 7 PRIOR ART
FIG. 7 is a side plan view of a treadmill with a conventional adjusting device in accordance with the prior art.

In addition, because the actuating device (10) is connected to the bottom of the tread board (20) directly but not connected to the stand (22), a large space for mounting the actuating device (10) with the transmission device is not needed. Therefore, the lowest position of the tread board (20) can be lowered, such that the user can use the treadmill at a lower position relative to a treadmill with a conventional adjusting device as shown in FIG. 7. Consequently, the stability and safety of using the treadmill are enhanced.

Figure 4:
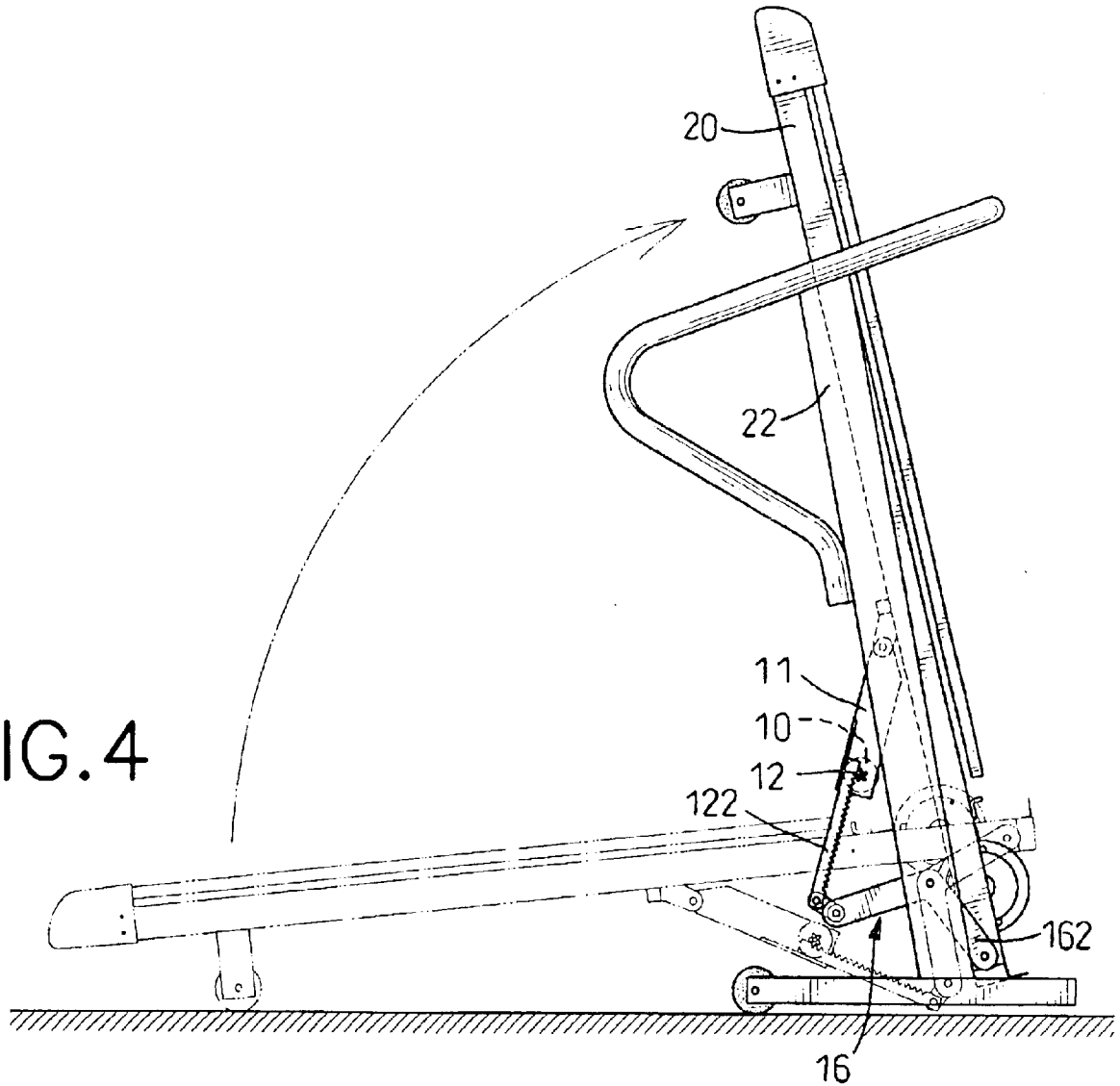
FIG. 4 is an operational side plan view of the treadmill with the adjusting device in FIG. 1 showing that the tread board with the adjusting device is folded relative to the stand.

With reference to FIG. 4, because the tread board (20) is pivotally connected to the stand (22) through the middle point of the connecting member (16), the tread board (20) can be lifted relative to the stand (22) with a pivot at the middle point of the connecting member (16). In the meantime, the actuating device (10) and the transmission device attached to the bottom of the tread board (20) will move with the tread board (20), such that the space for storing or transporting the treadmill is reduced.

Figure 5:
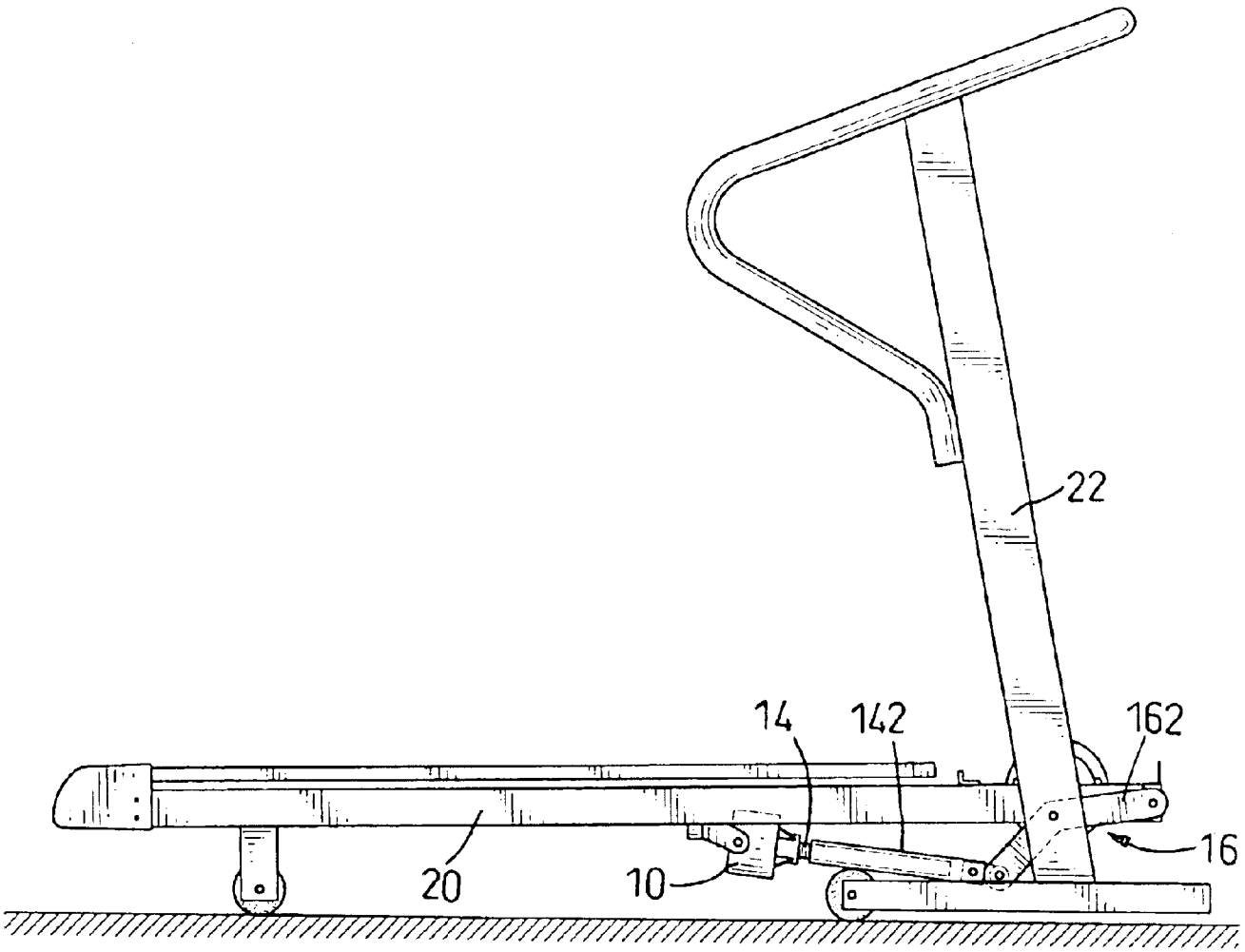
FIG. 5 is a side plan view of a treadmill with a second embodiment of an adjusting device in accordance with the present invention.
Figure 6:
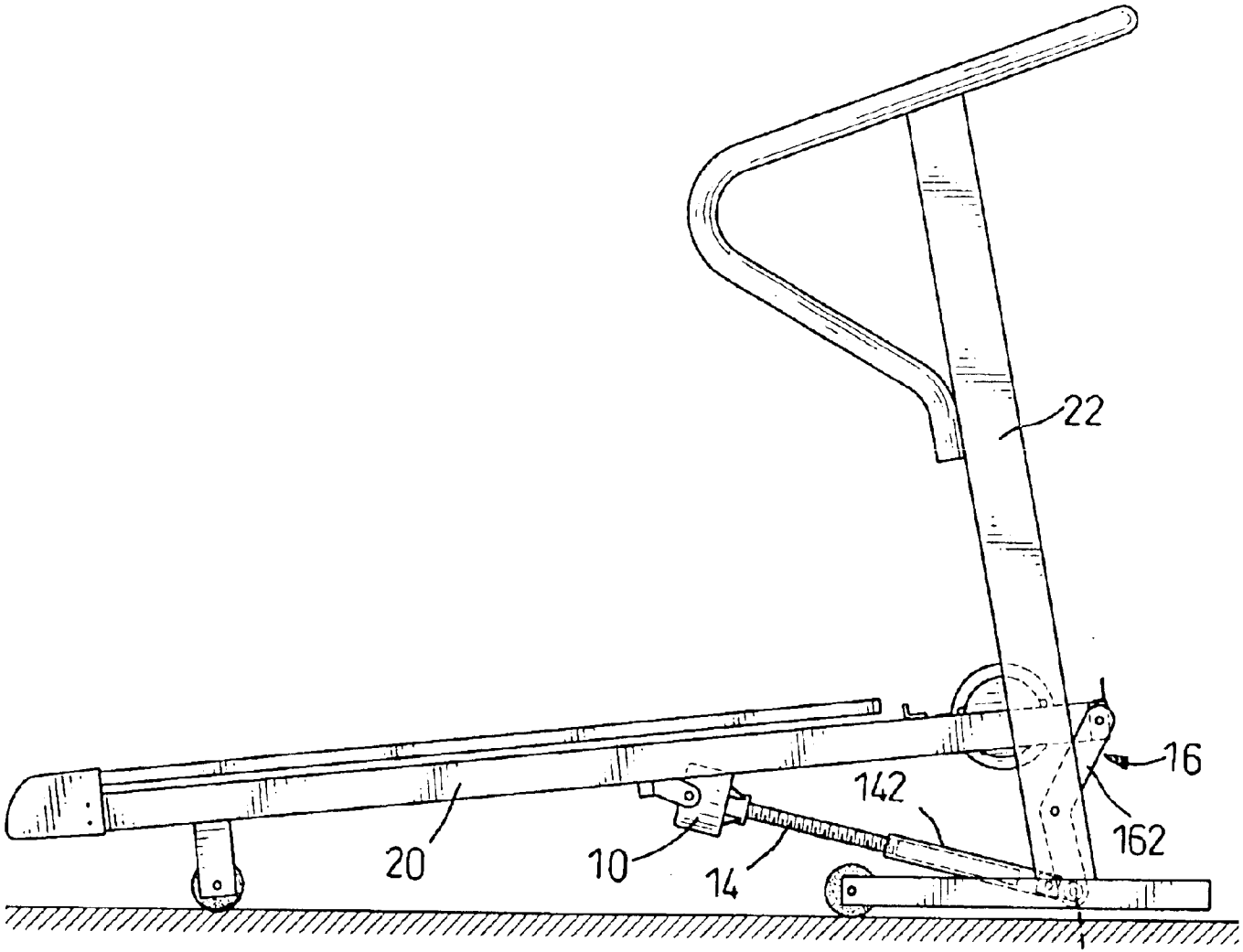
FIG. 6 is an operational side plan view of the treadmill with the adjusting device in FIG. 5 showing that the angle of the tread board is adjusted.

In a second embodiment, with reference to FIGS. 5 and 6, the actuating device (10) is a motor that is pivotally attached to the bottom of the tread board (20). The transmission device comprises a threaded rod (14) and a sleeve (142). The thread rod (14) is co-axially connected to the shaft of the motor. The sleeve (142) has an inner thread defined in one end of the sleeve (142) to engage with the threaded rod (14). The other end of the sleeve (142) is pivotally connected to the middle point of the connecting bar (164) of the connecting member (16).

When the motor is switched on, the thread rod (14) will rotate with the shaft of the motor. The sleeve (142) will move inward or outward relative to the thread rod (14) due to the threaded engagement between the thread rod (14) and the sleeve (142). The pivoting arm (162) of the connecting member (16) will be pulled or pushed to pivotally rotate relative to the stand (22) so as to lift or lower the tread board (20). Accordingly, the angle of the tread board (20) relative to the ground can be adjusted.

Moreover, the actuating device (10) is a cylinder with a retractable rod to serve as the transmission device. The retractable rod is pivotally connected to the connecting member (16), such that the connecting member (16) can be actuated to pivotally rotate relative to the stand (22) while the retractable rod moves.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. An adjusting device for a tread board of a treadmill comprising:

an actuating device adapted to be pivotally connected to a bottom of the tread board;

a transmission device connected to the actuating device; and a connecting member connected to the transmission device with a first end and having a second end adapted to be pivotally attached to the tread board and a middle point adapted to be pivotally attached to a stand of the treadmill, whereby the actuating device and the transmission device can pivotally rotate relative to the tread board during the operation of the adjusting device.

2. The adjusting device as claimed in claim 1, wherein the actuating device is a motor; and the transmission device comprises a pinion connected to a shaft of the motor and a rack engaging with the pinion and pivotally connected to the connecting member.

3. The adjusting device as claimed in claim 2 further comprising a bracket adapted to be pivotally attached to the bottom of the tread board and for the actuating device being mounted on the bracket, wherein the bracket has a tab laterally extending from a bottom of the bracket to support the rack.

4. The adjusting device as claimed in claim 3, wherein the connecting member comprises:

two pivoting arms adapted to be respectively located on two sides of the tread board, each pivoting arm having an end adapted to be pivotally attached to one side of the tread board and a middle point adapted to be pivotally attached to the stand; and a connecting rod connected between the pivoting arms and having a middle point pivotally connected to the rack.

5. The adjusting device as claimed in claim 1, wherein the actuating device is a motor; and the transmission device comprises a threaded rod co-axially connected to a shaft of the motor and a sleeve having an inner thread engaging with the threaded rod and an end pivotally connected to the connecting member.

6. The adjusting device as claimed in claim 5, wherein the motor is pivotally attached to the bottom of the tread board.

7. The adjusting device as claimed in claim 5, wherein the connecting member comprises:

two pivoting arms adapted to be respectively located on two sides of the tread board, each pivoting arm having an end adapted to be pivotally attached to one side of the tread board and a middle point adapted to be pivotally attached to the stand; and a connecting rod connected between the pivoting arms and having a middle point pivotally connected to the end of the sleeve.

8. The adjusting device as claimed in claim 1, wherein the actuating device is a cylinder with a retractable rod to serve as the transmission device and to be pivotally connected to the connecting member.

9. The adjusting device as claimed in claim 8, wherein the connecting member comprises:

two pivoting arms adapted to be respectively located on two sides of the tread board, each pivoting arm having an end adapted to be pivotally attached to one side of the tread board and a middle point adapted to be pivotally attached to the stand; and a connecting rod connected between the pivoting arms and having a middle point pivotally connected to the retractable rod of the cylinder.

* * * * *